US012116761B2

(12) United States Patent
Nakajima

(10) Patent No.: US 12,116,761 B2
(45) Date of Patent: Oct. 15, 2024

(54) DRAIN UNIT

(71) Applicant: SANEI LTD., Osaka (JP)

(72) Inventor: Kazuaki Nakajima, Osaka (JP)

(73) Assignee: SANEI LTD., Osaka (JP)

( * ) Notice: Subject to any disclaimer, the term of this patent is extended or adjusted under 35 U.S.C. 154(b) by 0 days.

(21) Appl. No.: 18/281,953

(22) PCT Filed: Oct. 26, 2022

(86) PCT No.: PCT/JP2022/040007
§ 371 (c)(1),
(2) Date: Sep. 13, 2023

(87) PCT Pub. No.: WO2024/089824
PCT Pub. Date: May 2, 2024

(65) Prior Publication Data
US 2024/0254744 A1 Aug. 1, 2024

(51) Int. Cl.
*E03C 1/14* (2006.01)
*A47K 1/14* (2006.01)

(52) U.S. Cl.
CPC ..... *E03C 1/14* (2013.01); *A47K 1/14* (2013.01)

(58) Field of Classification Search
CPC ..... A47K 1/14; E03C 1/14; E03C 1/22–244; E03C 1/23–2308; E03C 1/24–244;
(Continued)

(56) References Cited

U.S. PATENT DOCUMENTS 3,911,508 A * 10/1975 Goldberg ..... E03C 1/264 4/295
6,490,738 B2 * 12/2002 Blaney ..... E03C 1/23 137/516.13
(Continued)

FOREIGN PATENT DOCUMENTS

CN 111827420 A 10/2020
DE 480935 C 8/1929
(Continued)

OTHER PUBLICATIONS

Office Action issued on Feb. 29, 2024 for CN application No. 202280017814.9.
(Continued)

*Primary Examiner* — David P Angwin
*Assistant Examiner* — Nicholas A Ros
(74) *Attorney, Agent, or Firm* — Li & Cai Intellectual Property Office

(57) ABSTRACT

To provide a drain unit and a wash-basin capable of solving various problems relating to a wash-basin with an overflow hole formed at a bowl part. A drain unit includes a first cylindrical body 10 to be mounted on a drain port 112, a second cylindrical body 20 provided inside the first cylindrical body 10, and a water plug member 30 provided at the second cylindrical body 20. The water plug member 30 is capable of closing an opening of the second cylindrical body 20. A flow path 60 is provided between the first cylindrical body 10 and the second cylindrical body 20. The second cylindrical body 20 has an opening part 24 through which the flow path 60 and space in an inside part of the second cylindrical body 20 communicate with each other.

6 Claims, 3 Drawing Sheets

(58) Field of Classification Search
CPC ..... E03C 1/26–264; E03C 1/28–292; E03C 2001/02413; E03C 2001/2311–2317
See application file for complete search history.

(56) References Cited

U.S. PATENT DOCUMENTS

| | | | | |
|---|---|---|---|---|
| 7,320,336 | B2 * | 1/2008 | Herring | E03C 1/2302 251/339 |
| 11,680,397 | B2 * | 6/2023 | Ahuja | E03C 1/2306 4/295 |
| 2006/0237070 | A1 | 10/2006 | Herring et al. | |
| 2015/0000022 | A1 | 1/2015 | Cho | |
| 2019/0323216 | A1 | 10/2019 | Yoshizawa et al. | |

FOREIGN PATENT DOCUMENTS

| | | | | |
|---|---|---|---|---|
| DE | 10318382 | * | 12/2003 | E03C 1/232 |
| DE | 202018001518 | * | 4/2018 | E03C 1/2306 |
| JP | 5245529 | U | 3/1977 | |
| JP | 2015507113 | A | 3/2015 | |
| JP | 2016204895 | A | 12/2016 | |
| JP | 201889263 | A | 6/2018 | |
| JP | 202084574 | A | 6/2020 | |
| JP | 202175890 | A | 5/2021 | |

OTHER PUBLICATIONS

European Search Report issued on Mar. 26, 2024 for EP application No. 22924555.0.

* cited by examiner

DRAIN UNIT

FIELD OF THE DISCLOSURE

The present disclosure relates to a drain unit and a wash-basin.

BACKGROUND OF THE DISCLOSURE

As an example, Patent Literature 1 discloses a wash-basin including a bowl part provided with an overflow hole, and an overflow part provided with an overflow flow path communicating with the overflow hole. The overflow part is provided at the bowl part in such a manner as to bulge at the back of the bowl part.

Patent Literature 1: Japanese Unexamined Patent Application Publication No. 2018-089263.

Technical Problem

The wash-basin with the overflow hole formed at the bowl part has various problems such as a problem in a hygienic aspect, a problem in an aesthetic aspect, and a problem in a manufacturing process. The problem in a hygienic aspect is caused by invasion of harmful insects through the overflow hole, for example. The problem in an aesthetic aspect is caused by the bulge of the overflow part at the back of the bowl part, for example. The problem in a manufacturing process is caused by the reason that, while a bowl with a cavity such as an overflow flow path is generally manufactured by a sludge removal manufacturing method, the sludge removal manufacturing method involves many steps and results in large weight of a wash-basin. There is another problem in that, if a wash-basin without an overflow function is already installed, trying to make a change to a wash-basin having an overflow function requires replacement of a wash-basin.

SUMMARY OF THE DISCLOSURE

The present disclosure is intended to provide a drain unit and a wash-basin capable of solving the various problems described above.

Solution to Problem

A drain unit according to the present disclosure comprises: a first cylindrical body to be mounted on a drain port; a second cylindrical body provided inside the first cylindrical body; and a water plug member provided inside the second cylindrical body. The water plug member is capable of closing an inside part of the second cylindrical body. A flow path is provided between the first cylindrical body and the second cylindrical body. The second cylindrical body has an opening part through which the flow path and space in the inside part of the second cylindrical body communicate with each other.

In the above-described drain unit, even if the inside part of the second cylindrical body is closed while water is supplied, the supplied water enters the flow path provided between the first cylindrical body and the second cylindrical body. The water having entered the flow path between the first cylindrical body and the second cylindrical body passes through the opening part, enters the space in the inside part of the second cylindrical body, and is discharged through the drain port. Using this drain unit can suppress overflow of water from a bowl part and eliminate the need for an overflow hole, making it possible to solve the above-described various problems. Furthermore, even a wash-basin already installed without an overflow function can be given an overflow function by only mounting the above-described drain unit on this wash-basin.

The drain unit may further comprise: a valve arranged in the flow path in such a manner as to face the opening part; and resistance means that applies resistive power to the valve toward a direction opposite to a flow path direction. Water pressure acting on the valve changes in response to the water level of water stored in a bowl. In an initial period when water supply is started, the amount of water entering the inside part of the second cylindrical body through the opening part is small so water is stored easily in the bowl part. When water is stored in the bowl part and water pressure acting on the valve becomes greater than the resistive power, the valve moves in the flow path direction. When the valve moves in the flow path direction, water enters the inside part of the second cylindrical body through the opening part from the flow path, making it possible to suppress overflow of water from the bowl part.

The resistance means may have a spring that biases the valve. With a simple configuration of only providing the spring on the side of the flow path direction relative to the valve, it is possible to apply resistive power to the valve toward a direction opposite to the flow path direction.

A wash-basin according to the present disclosure may comprise: the drain unit according to the present disclosure; and a bowl having a bottom where the drain port is provided. This makes it possible to provide a wash-basin including a bowl part where an overflow hole is not formed, so that the above-described various problems can be solved.

Advantageous Effects of Invention

According to the present disclosure, it is possible to provide a drain unit and a wash-basin capable of solving the various problems described above.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
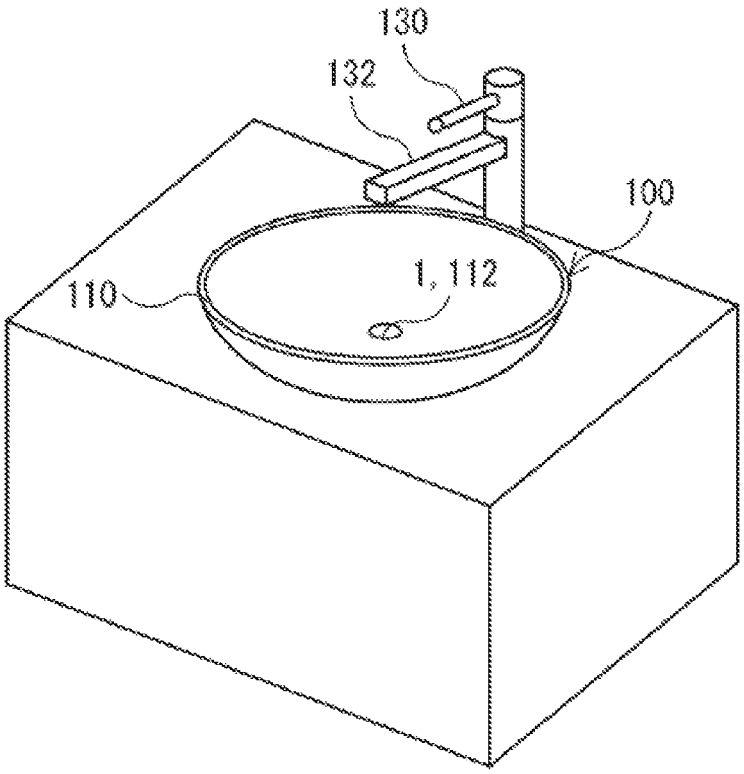
FIG. 1 is a schematic view showing a wash-basin of the present disclosure and the vicinity thereof.
Figure 2:
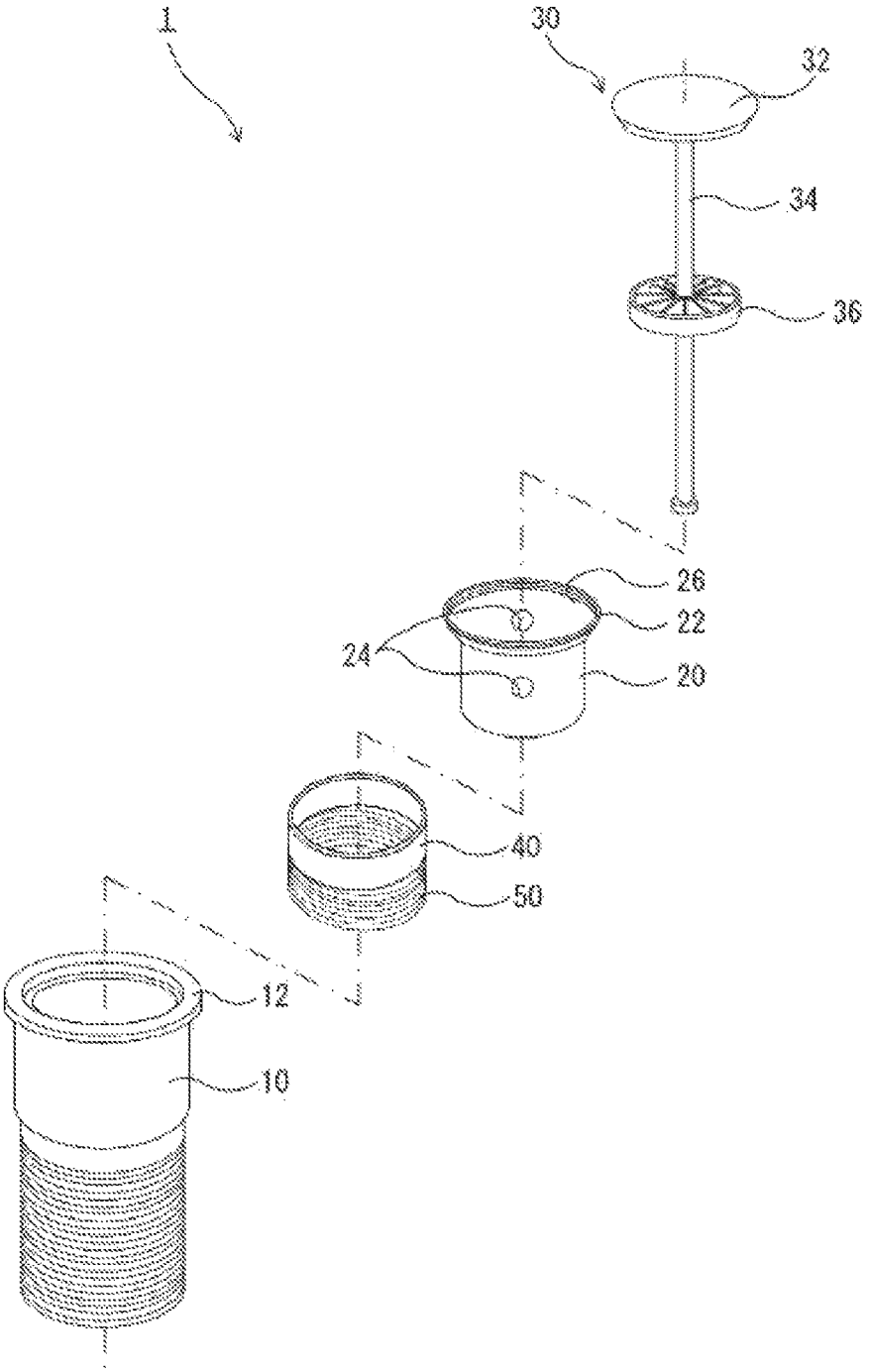
FIG. 2 is an exploded perspective view showing an example of a drain unit of the present disclosure.
Figure 3:
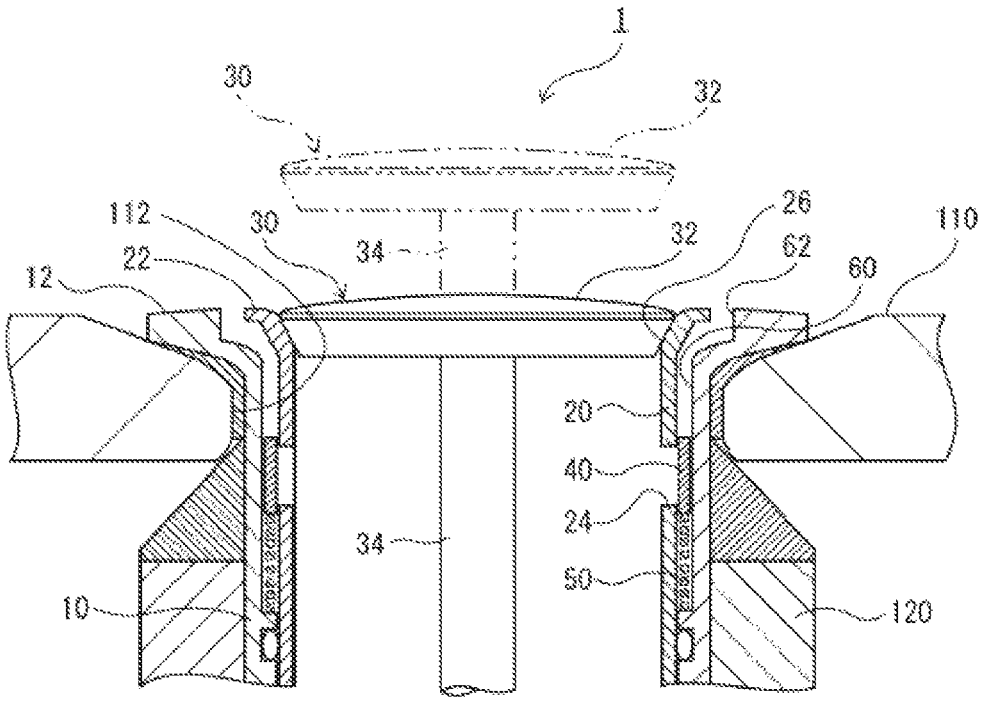
FIG. 3 is a partial longitudinal sectional view showing an example of a case where the drain unit of the present disclosure is mounted on a drain port.

An embodiment of the present disclosure will be described by referring to the drawings. In FIGS. 1 to 3 referred to below, members common between the drawings are given the same reference number. In the present description, an upward direction means an upward direction on the planes of the drawings, and a downward direction means a downward direction on the planes of the drawings.

FIG. 1 is a schematic view showing a wash-basin 100 of the present disclosure and the vicinity thereof. The wash-basin 100 includes a wash bowl 110 and a drain unit 1. The wash bowl 110 has a drain port 112 provided at a bottom thereof. The drain unit 1 is mounted on the drain port 112 of the wash bowl 110. When a spout handle 130 is operated, water is supplied from a spout pipe 132. The supplied water is discharged through the drain port 112 on which the drain unit 11 is mounted.

By referring to FIG. 2, various members belonging to the drain unit 1 of the present disclosure will be described first in terms of their shapes, etc. FIG. 2 is an exploded perspective view showing an example of the drain unit 1 of the present disclosure.

The drain unit 1 includes at least a first cylindrical body 10, a second cylindrical body 20, and a water plug member 30. In the present embodiment, the second cylindrical body 20 and the water plug member 30 are configured as separate bodies. Alternatively, the second cylindrical body 20 and the water plug member 30 may be integrated with each other.

The first cylindrical body 10 is a circular cylindrical member made of stainless steel, for example. The first cylindrical body 10 has a diameter slightly less than that of the drain port 112 (see FIG. 1). The first cylindrical body 10 has a first flange part 12 extending in a peripheral direction and provided at an upper end portion of the first cylindrical body 10 in a circular cylindrical axis direction.

The second cylindrical body 20 is a circular cylindrical member made of stainless steel, for example, and is fitted to the inside of the first cylindrical body 10. The second cylindrical body 20 has a second flange part 22 extending in a peripheral direction and provided at an upper end portion of the second cylindrical body 20 in a circular cylindrical axis direction. The second cylindrical body 20 has an opening part 24 formed at a circular cylindrical section of the second cylindrical body 20. In the present embodiment, the second cylindrical body 20 has two opening parts 24 arranged in a peripheral direction of the circular cylindrical section. However, the number of the opening parts 24 is not limited to two.

The water plug member 30 has a drain plug 32, a shaft part 34, and a catcher 36. The drain plug 32 is a member of a circular plate shape made of stainless steel, for example. The drain plug 32 can close a radially inside part of the second cylindrical body 20 by closing an opening 26 of the second cylindrical body 20 at one of the end portions of the second cylindrical body 20 in the circular cylindrical axis direction. The drain plug 32 has a fitting (not shown in the drawings) provided at the center of a lower surface thereof for fitting the shaft part 34.

The shaft part 34 is a member of a straight rod shape made of stainless steel, for example. The shaft part 34 has an upper end portion that is fitted to the fitting of the drain plug 32 in such a manner as to be perpendicular to the drain plug 32. The shaft part 34 is movable in an up-down direction by a mechanism not shown in the drawings abutting on a lower end portion of the shaft part 34. In response to the movement of the shaft part 34 in the up-down direction, the water plug member 30 entirely moves in the up-down direction.

The catcher 36 is a circular member centered at the shaft part 34 and made of resin, for example. The catcher 36 has a large number of holes in order to suppress flowing out of hair, dust, etc. into a drain pipe 120 (see FIG. 3 referred to later). The catcher 36 is movable up and down while an outer peripheral surface of the catcher 36 and an inner peripheral surface of the second cylindrical body 20 abut on each other so as to prevent hair, dust, etc. from flowing out from between the outer peripheral surface of the catcher 36 and the inner peripheral surface of the second cylindrical body 20.

The drain unit 1 is mounted on the drain port 112 while the second cylindrical body 20 is fitted to the inside of the first cylindrical body 10 and the water plug member 30 is arranged in the radially inside part of the second cylindrical body 20. As long as the drain unit 1 can be mounted on the drain port 112, the mounting is not limited to a particular procedure. As an example, the procedure may be such that, after the first cylindrical body 10 is mounted on the drain port 112 of the wash bowl 110, the second cylindrical body 20 is fitted to the inside of the first cylindrical body 10 and the water plug member 30 is arranged in the radially inside part of the second cylindrical body 20. The procedure may also be such that, after the first cylindrical body 10 with the second cylindrical body 20 fitted therein is mounted on the drain port 112 of the wash bowl 110, the water plug member 30 is arranged in the radially inside part of the second cylindrical body 20. Either mounting procedure allows the drain unit 1 to be mounted easily on the drain port 112.

The drain unit 1 may further include a valve 40 and resistance means 50. In the present embodiment, the valve 40 and the resistance means 50 are provided in a radially inside part of the first cylindrical body 10 and a radially outside part of the second cylindrical body 20.

The valve 40 is a circular cylindrical member made of stainless steel, for example. The resistance means 50 is provided under the valve 40 and biases the valve 40 upward. The resistance means 50 is a spring, for example. In the present embodiment, a coil spring is employed as the resistance means 50.

The first cylindrical body 10, the second cylindrical body 20, the drain plug 32, the shaft part 34, and the valve 40 are not limited to members made of stainless steel but may be made of other types of metal or resin, for example. Likewise, the catcher 36 is not limited to a member made of resin but may be made of metal such as stainless steel. Note that each of the first cylindrical body 10, the second cylindrical body 20, the drain plug 32, the shaft part 34, the valve 40, and the catcher 36 is preferably made of a material resistant to corrosion with good maintainability, for example.

Even if the drain unit 1 includes the valve 40 and the resistance means 50, mounting of the drain unit 1 on the drain port 112 is not limited to a particular mounting procedure.

Operation of the drain unit 1 of the present disclosure will be described next by referring to FIG. 3. FIG. 3 is a longitudinal sectional view showing an example of a case where the drain unit 1 is mounted on the drain port 112 of the wash bowl 110. FIG. 3 is a partial longitudinal sectional view showing the water plug member 30 in a side view, not in a sectional view. In FIG. 3, the water plug member 30 is movable between a first position indicated by alternate long and two short dashes lines and a second position indicated by solid lines.

The wash bowl 110 is arranged in such a manner as to form communication of the drain port 112 with the drain pipe 120. When the drain unit 1 is mounted on the drain port 112 of the wash bowl 110, the opening 26 of the second cylindrical body 20 and the drain pipe 120 communicate with each other. Water entering from the opening 26 of the second cylindrical body 20 passes through space in the radially inside part of the second cylindrical body 20 and is then discharged to the drain pipe 120. While the drain unit 1 is mounted on the drain port 112, the first flange part 12 and the drain port 112 are closed relative to each other.

While the drain unit 1 is mounted on the drain port 112, a clearance is formed between the first cylindrical body 10 and the second cylindrical body 20. This clearance forms a flow path 60 for allowing entry of water. A clearance between the first flange part 12 and the second flange part 22 is an inlet 62 to the flow path 60. The valve 40 and the resistance means 50 are arranged in this flow path 60.

Operation of the drain unit 1 fulfilled by the provision of the first cylindrical body 10, the second cylindrical body 20, and the water plug member 30 will be described first. Further operation of the drain unit 1 fulfilled by the provision of the valve 40 and the resistance means 50 will be described next.

As described above, the water plug member 30 entirely moves in the up-down direction when the shaft part 34 moves in the up-down direction. Meanwhile, the first cylindrical body 10, the second cylindrical body 20, the valve 40, and the resistance means 50 do not move in response to the movement of the water plug member 30 in the up-down direction.

When the water plug member 30 moves upward, the opening 26 of the second cylindrical body 20 becomes opened. The opening 26 is opened at the above-described first position. When the opening 26 is opened, water supplied from the spout pipe 132 (see FIG. 1) passes through the opening 26 and is then discharged to the drain pipe 120 except water flowing into the flow path 60. The amount of water to be discharged to the drain pipe 120 through the opening 26 while the opening 26 is opened differs in response to a place of installation. Preferably, this amount is greater than the amount of water to be supplied from the spout pipe 132. The amount of water to be supplied from the spout pipe 132 can be a maximum amount of water to be supplied or can be the amount of water to be supplied that is determined on the basis of a predetermined design standard.

When the water plug member 30 moves downward to reach the above-described second position, the opening 26 is blocked by the drain plug 32 and is closed. When the opening 26 is closed, supplied water is stored in the wash bowl 110.

The inlet 62 to the flow path 60 is always opened. Even if the opening 26 is closed, supplied water still enters the flow path 60. The flow path 60 and the space in the radially inside part of the second cylindrical body 20 communicate with each other through the opening part 24. Water having entered the flow path 60 flows into the space in the radially inside part of the second cylindrical body 20 through the opening part 24. The space in the radially inside part of the second cylindrical body 20 communicates with the drain pipe 120. Water having flowed into the space in the radially inside part of the second cylindrical body 20 is discharged to the drain pipe 120. The amount of water to enter the flow path 60 and to be discharged while the opening 26 is closed is less than the amount of water to be supplied (for example, a maximum amount of water to be supplied) responsive to a place of installation.

In the drain unit 1 of the present disclosure, closing the opening 26 allows supplied water to be stored in the wash bowl 110. Even when the opening 26 is closed, supplied water still enters the flow path 60 and is discharged. Thus, it is possible to suppress overflow of water from the wash bowl 110 even without provision of an overflow hole at the wash bowl 110.

The presence of an overflow hole at a wash bowl causes a risk of invasion of harmful insects through the overflow hole, so that room is left for improvement in a hygienic aspect. Moreover, the wash bowl with the overflow hole has a bulge at its back in order to assure a flow path for water entering through the overflow hole, resulting in poor aesthetic property. As aesthetic property is required particularly in the case of a vessel type, a bulge at the back of the wash bowl is preferred. Furthermore, while the wash bowl with the overflow hole is generally manufactured by a sludge removal manufacturing method, the manufacture has difficulty as the sludge removal manufacturing method involves many steps and results in large weight of a wash-basin. Mounting the drain unit 1 of the present disclosure on a drain port of the wash bowl eliminates the need to provide the overflow hole at the wash bowl. As a result, the various problems relating to a wash-basin with the overflow hole at the wash bowl are solved. As the drain unit 1 can easily be mounted on the drain port 112 of the wash bowl 110 as described above, excellent maintainability is provided and cleanliness can be kept. In particular, as the wash bowl does not have a bulge at its back in the absence of an overflow hole at the wash bowl, aesthetic property is not damaged even in the case of a vessel type.

If a wash-basin without an overflow function is already installed, for example, trying to make a change to a wash-basin having an overflow function requires replacement of a wash-basin. In this regard, the drain unit 1 of the present disclosure has a simple configuration of only being mounted on the drain port 112 and can easily take the place of a drain unit mounted on a wash-basin already installed. As a result, it is possible to change a wash-basin without an overflow function to a wash-basin with an overflow function without the need of replacing a wash-basin.

The amount of water to enter the flow path 60 and to be discharged is determined on the basis of the size of the clearance between the first cylindrical body 10 and the second cylindrical body 20, the number of the opening parts 24, the size of the opening part 24, etc. The amount of water to enter the flow path 60 and to be discharged while the opening 26 is closed is determined in response to the amount of water to be supplied from the spout pipe 132. For this reason, the size of the clearance between the first cylindrical body 10 and the second cylindrical body 20, the number of the opening parts 24, and the size of the opening part 24 are determined in response to the amount of water to be supplied responsive to a place of installation.

Further operation of the drain unit 1 fulfilled by the provision of the valve 40 and the resistance means 50 will be described next.

As described above, the resistance means 50 biases the valve 40 upward. A coil spring as the resistance means 50 is arranged under the valve 40 in series with a direction of water flowing in the flow path 60. A direction of biasing the valve 40 by the resistance means 50 is opposite to the direction of water flowing in the flow path 60.

While water is not stored in the wash bowl 110, the valve 40 faces the opening part 24 of the second cylindrical body 20 in such a manner as to close the opening part 24 entirely. When the valve 40 faces the opening part 24 in such a manner as to close the opening part 24 entirely, flow of water from the flow path 60 toward the space in the radially inside part of the second cylindrical body 20 is restricted. The restriction on the flow of water from the flow path 60 toward the space in the radially inside part of the second cylindrical body 20 makes it unlikely that flow of water will be generated in the flow path 60. This results in a state where water is stored in the flow path 60, so that water is stored easily in the wash bowl 110.

When water is stored in the wash bowl 110 while the opening 26 of the second cylindrical body 20 is closed, a downward load acts on the valve 40. This load can be reworded as water pressure. In response to the level of water pressure acting downward on the valve 40, the valve 40 moves downward, which is a direction in which water flows in the flow path 60. When the valve 40 moves downward, an opening area of the opening part 24 is increased in response to the amount of downward movement of the valve 40. When the opening part 24 is opened, water in the flow path 60 passes through the opening part 24, flows into the radially inside part of the second cylindrical body 20, and is then discharged to the drain pipe 120.

Water pressure acting on the valve 40 changes in response to the water level of water stored in the wash bowl 110. In an initial period when storing of water in the wash bowl 110 is started, a water level is low to result in low water pressure acting on the valve 40 and a small opening area of the opening part 24. The small opening area of the opening part 24 reduces the amount of water flowing in the flow path 60, so that water is stored in the wash bowl 110 easily. When the water level of water stored in the wash bowl 110 becomes higher, water pressure acting on the valve 40 is increased to increase an opening area of the opening part 24. The increase in opening area of the opening part 24 increases the amount of water flowing in the flow path 60.

In the drain unit 1 of the present disclosure including the valve 40 and the resistance means 50, in an initial period when the opening 26 of the second cylindrical body 20 is closed and water supply is started, water is unlikely to flow in the flow path 60 so water is stored easily in the wash bowl 110. When the water level of water stored in the wash bowl 110 becomes higher, the amount of water flowing in the flow path 60 is increased. Thus, even when the opening 26 of the second cylindrical body 20 is closed, it is still possible to suppress overflow of water from the wash bowl 110.

As described above, in the drain unit 1 of the present disclosure, a coil spring is employed as the resistance means 50. For the reason that the valve 40 is a circular cylindrical member, it is possible to bias the valve 40 in the upward direction by a simple configuration of only arranging the coil spring as the resistance means 50 under the valve 40.

In the drain unit 1 of the present disclosure, a coil spring is employed as the resistance means 50. Meanwhile, as long as the resistance means 50 has a function of biasing the valve 40, the resistance means 50 is not limited to a coil spring. Furthermore, it is sufficient for the resistance means 50 to apply force on the valve 40 acting in a direction opposite to the direction of water flowing in the flow path 60, namely, acting in a direction against water pressure. For example, a coil spring may be provided on upper side the valve 40 and the valve 40 may be pulled (biased) upward. In another case, the drain unit 1 may include a pressure sensor that detects water pressure acting downward on the valve 40, and a mechanism and a controller that move the valve 40 in response to the water pressure detected by the pressure sensor.

While the valve 40 and the resistance means 50 are arranged in the flow path 60 in the drain unit 1 of the present disclosure, the valve 40 and the resistance means 50 are not limited to these arrangements in the flow path 60. It is sufficient for the valve 40 to be movable between a position of closing the opening part 24 and a position of opening the opening part 24 in response to water pressure generated in the flow path 60. As an example, if a section to receive water pressure is arranged in the flow path 60 and if this section to receive water pressure is formed integrally with the valve 40, the valve 40 and the resistance means 50 can be arranged, for example, in the space in the radially inside part of the second cylindrical body 20.

A place of mounting the drain unit 1 of the present disclosure is not limited to the drain port 112 of the wash bowl 110 but the drain unit 1 is mountable on a drain port of a bathtub, a drain port of a kitchen sink, a drain port provided at a water tank in a toilet, etc. Even in these cases, operation and effect comparable to those fulfilled by mounting the drain unit 1 of the present disclosure on the wash bowl 110 are still fulfilled.

The embodiment disclosed herein should be construed as being illustrative in all aspects and should not be construed as being restrictive. The fundamental scope of the present disclosure is shown not by the foregoing embodiment but by the claims, and is intended to include all changes within meanings and scopes of equivalents to the claims.

REFERENCE SIGNS LIST

10 First cylindrical body
20 Second cylindrical body
30 Water plug member
60 Flow path
24 Opening part
40 Valve
50 Resistance means
110 Wash bowl

What is claimed is:

1. A drain unit comprising:
a first cylindrical body to be mounted on a drain port;
a second cylindrical body provided inside the first cylindrical body; and
a water plug member provided inside the second cylindrical body, wherein
the water plug member is capable of closing an inside part of the second cylindrical body,
a flow path is provided between the first cylindrical body and the second cylindrical body, and
the second cylindrical body has an opening part through which the flow path and space in the inside part of the second cylindrical body communicate with each other, and
wherein the drain unit further comprises:
a valve provided in a radial space between the second cylindrical body and the first cylindrical body constituting the flow path and configured to directly cover and close the opening part so as to block a flow of water therethrough; and
a resistant body coupled to the valve to apply resistive power to the valve toward a direction opposite to a flow path direction.

2. The drain unit according to claim 1, wherein
the resistant body has a spring that biases the valve.

3. The drain unit according to claim 1, wherein
the valve is further configured to be movable between an open position in the radial space between the second cylindrical body and the first cylindrical body and a closed position in the radial space between the second cylindrical body and the first cylindrical body, the valve in the close position directly covering/closing the opening part so as to block the flow of water therethrough, the valve in the open position opening the opening part.

4. The drain unit according to claim 1, wherein
the resistant body is provided under the valve in the radial space between the second cylindrical body and the first cylindrical body.

5. The drain unit according to claim 1, wherein
the resistant body comprises:
a pressure sensor configured to detect water pressure acting downward on the valve; and
a mechanism and a controller configured to move the valve in response to the water pressure detected.

6. A wash-basin comprising:

the drain unit according to any one of claims 1, 2, 3, 4, and 5; and a bowl having a bottom where the drain port is provided.

* * * * *